US006826846B2

(12) United States Patent
Fordham

(10) Patent No.: US 6,826,846 B2
(45) Date of Patent: Dec. 7, 2004

(54) DEVICE FOR MARKING OUT A PATTERN ON A SURFACE

(76) Inventor: Paul Ralph Fordham, 19 Station Road., Blunham, Bedfordshire MK44 3NZ (GB)

( * ) Notice: Subject to any disclaimer, the term of this patent is extended or adjusted under 35 U.S.C. 154(b) by 0 days.

(21) Appl. No.: 10/344,306

(22) PCT Filed: Aug. 13, 2001

(86) PCT No.: PCT/GB01/03666

§ 371 (c)(1),
(2), (4) Date: Feb. 7, 2003

(87) PCT Pub. No.: WO02/16148

PCT Pub. Date: Feb. 28, 2002

(65) Prior Publication Data

US 2003/0177655 A1 Sep. 25, 2003

(30) Foreign Application Priority Data

Aug. 23, 2000 (GB) ..... 0020644
Jun. 16, 2001 (GB) ..... 0114770

(51) Int. Cl.[7] ..... B43L 7/14
(52) U.S. Cl. ..... 33/562; 33/528
(58) Field of Search ..... 33/528, 27.63, 33/413, 427, 430, 436, 451, 452, 454, 464, 474, 760, 562, 563, 566

(56) References Cited

U.S. PATENT DOCUMENTS

| | | | | | |
|---|---|---|---|---|---|
| 1,045,300 | A | * | 11/1912 | Lary | 33/27.03 |
| 2,814,117 | A | | 11/1957 | Siems | |
| 3,120,707 | A | | 2/1964 | Ewing | |
| 3,156,046 | A | | 11/1964 | Potter | |
| 3,672,064 | A | * | 6/1972 | Elkins et al. | 33/528 |
| 3,811,191 | A | * | 5/1974 | Kelly | 33/663 |
| 3,842,510 | A | * | 10/1974 | Elliot | 33/528 |
| 4,171,574 | A | | 10/1979 | Gratzl et al. | |
| 4,317,289 | A | * | 3/1982 | Conn | 33/498 |
| 4,833,791 | A | * | 5/1989 | Campbell | 33/562 |
| 5,022,158 | A | * | 6/1991 | Beyer | 33/413 |
| 5,131,164 | A | * | 7/1992 | Miller | 33/613 |
| 5,494,372 | A | | 2/1996 | Oliver et al. | |
| 5,894,675 | A | * | 4/1999 | Cericola | 33/451 |
| 6,578,274 | B1 | * | 6/2003 | Tango et al. | 33/1 G |

* cited by examiner

*Primary Examiner*—Christopher W. Fulton
(74) *Attorney, Agent, or Firm*—Fildes & Outland, P.C.

(57) ABSTRACT

A measuring device (1) comprising a body (2) which is holdable against a surface for the marking out of a pattern thereon and a member (3, 4) extendable from the body (2), at least a portion of the area of the device body (2) defining at least a portion of the area of the pattern to be marked out.

8 Claims, 10 Drawing Sheets

DEVICE FOR MARKING OUT A PATTERN ON A SURFACE

This invention relates to a measuring device and, more specifically, to a measuring device suitable for use whilst building, in building maintenance or whilst decorating, which includes, inter alia, plastering, painting, stencilling, drawing or applying other substances to a surface. The invention also relates to a method of measuring out a pattern upon a surface.

Quite frequently, whilst decorating, for example, it is desirable to provide a straight line on the surface to be decorated. Common practice relies upon the use of plumb lines, spirit levels and/or set squares to achieve such a line. However, when a large area has to be divided into a series of parallel lines such an approach is time consuming and, moreover, systematic errors, which cause the lines to stray from a parallel arrangement, may be quite readily introduced.

In my co-pending British Patent Application No. 9928515.7, I disclose a method of providing a stone-effect finish to a surface by the application of a paint composition. In order to achieve a realistic stone-effect, rectangular areas are marked out upon the surface and the composition applied. By slightly altering the composition or, at least, altering the way in which it is applied, slightly different finishes are provided in each of the so-delineated areas, thereby enhancing the stone-effect look.

As mentioned above, if the surface to which the decorator wishes to apply the composition is large, then a very great number of areas must be marked out. The use of conventional means, as described above, can render this task very laborious. Indeed, for the amateur do-it-yourself enthusiast this may provide a barrier to their completing the application successfully and quickly.

It is also known that plasterers may require areas to be marked out in plaster once it has been applied to a surface, for example, to provide a French Caen stone finish. A similar situation may occur when rendering the outside of a building or where cladding is applied.

It is an object of the present invention to provide a device and method which allows a large area to be marked out accurately with, for example, a repeating pattern, without the need for accurate measurement. It is a further object to provide a device and method which obviates the need for marking out large areas accurately with plumb lines, set squares and the like and which facilitates such marking out.

According to a first aspect of the invention, there is provided a measuring device comprising a body which is holdable against a surface for the marking-out of a pattern thereon and a member extendable from the body, at least a portion of the area of the device body defining at least a portion of the area of the pattern to be marked out.

A second aspect of the invention resides in a method of marking out a pattern upon a surface comprising holding a device with an extendable member against the surface and using at least a portion of the device to mark out at least a portion of a desired pattern upon the surface.

Preferably, the device comprises at least two extendable members, each of which may be extendable from non-parallel faces or edges of the body of the device, such as orthogonal edges or faces There is provided, by a third aspect of the invention, a measuring device comprising a body which is holdable against a surface for the marking-out of a pattern thereon and two members extendable from orthogonal edges of the body, at least a portion of the area of the body defining at least a portion of the area of a pattern to be marked out.

The extendable member(s) may be extendable from a closed position to a fully extended position, the closed position being when the or each member is fully withdrawn and does not effectively protrude from the device body and the fully extended position being when the or each member is fully extended from the body.

The device may further comprise extension means to facilitate extension of the or each member. The or each member may be extendable in either a distinct or continuous fashion. In a distinct fashion, the extension means may comprise a resiliently urged member which is locatable, upon extension of the or each member, into, for example, one of a plurality of cavities. In a continuous fashion the extension means may comprise means to secure the or each member at a desired extension.

The extension means may also comprise a meter, such that the extension of the or each member is monitorable.

In a preferred embodiment the device comprises a generally planar rectangular body with the or each member extendable from orthogonal sides thereof. Preferably, the length of a long edge of the body is twice that of a short edge of the body. The device may also comprise a triangular, or other polygonal body, from at least one side of which a member is extendable.

Also, the or each extendable member may be formed from a correspondingly-shaped portion of the body of the device.

The device may also comprise means to indicate the horizontal and/or vertical aspect thereof, such as a spirit level and it preferably comprises two of such means to indicate non-parallel levels, such as a pair of orthogonal spirit levels.

Further, the device may also comprise means, such as an elongate member, preferably flexible, for example, a length of string, for marking-out a pattern, such as an arcuate pattern on a surface beyond the area of the body of the device. Such elongate member may be adjustable in length and may be provided at a free end thereof with a marker, for example, a pencil or pen.

Moreover the device may further comprise handle means to facilitate the positioning of the device at a desired location.

Various aspects of the invention will now be described, by way of example only, and with reference to the accompanying drawings in which.

Figure 1:
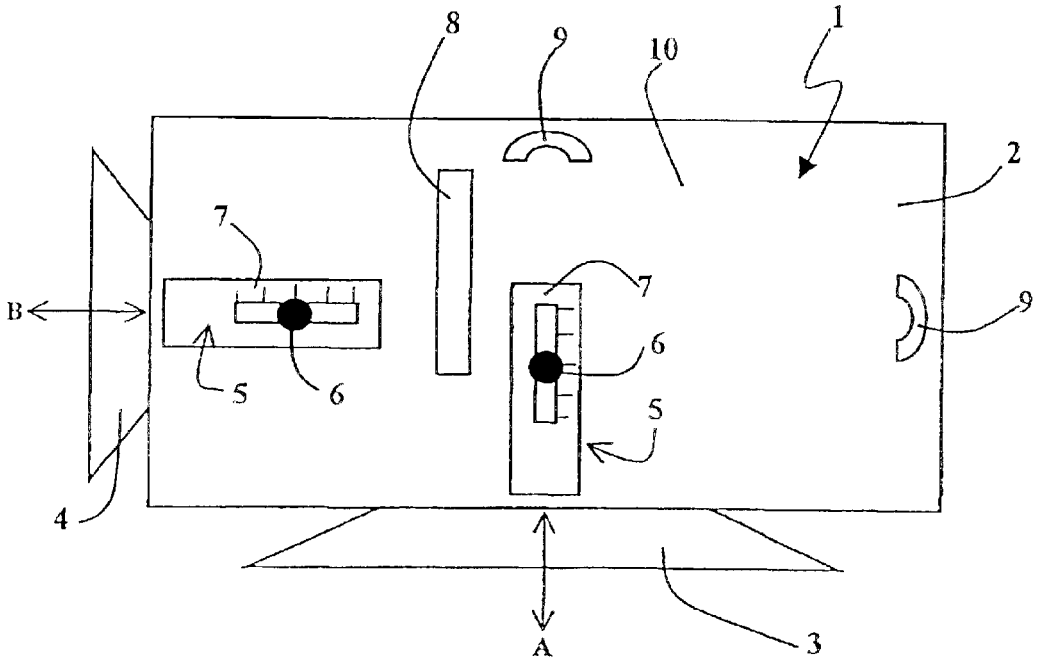
FIG. 1 shows a plan view of an embodiment of measuring device.
Figure 1A:
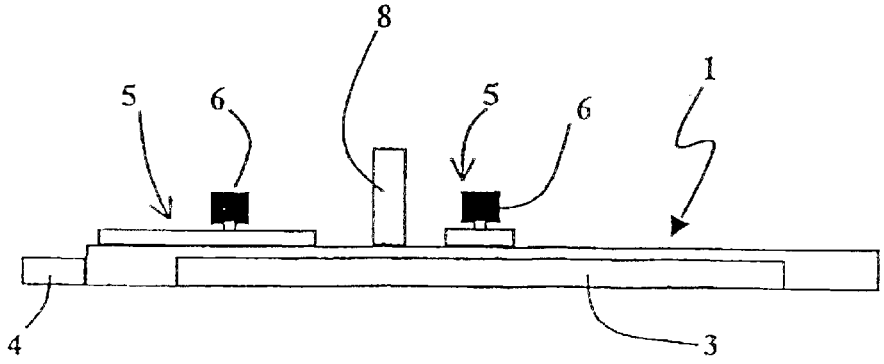
FIG. 1A shows a side elevation of the device of FIG. 1.

Referring, in the first instance, to FIGS. 1 and 1A, there is shown a measuring device 1 comprising a generally planar rectangular body 2 from which two members 3, 4 are extendable in the directions of arrows A and B respectively.

Each of the extendable members 3, 4 is extendable by virtue of extension means 5 comprising a spigot 6 slidable within a guide or measure 7 mounted to the device 1, the guide 7 indicating the degree of extension of member 3, 4.

The device 1 further comprises a handle 8 and a pair of spirit levels 9 which are mounted normally with respect to one another.

In this embodiment the device 1 comprises a laminate structure, each layer of which may be fabricated from, for example, hardboard or rigid plastics materials, the upper sheet being shown as 10.

Figure 2:
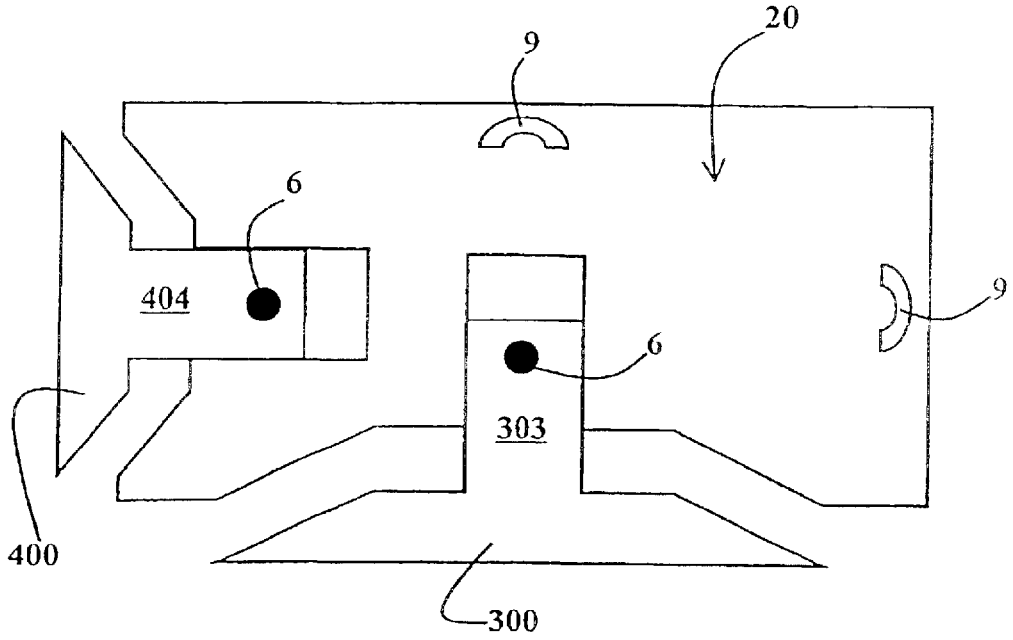
FIG. 2 shows a section through the device of FIG. 1.

FIG. 2 shows the intermediate layer 20 of the device 1. As can be clearly seen, each extendable member 3, 4 respectively comprises a trapezium 300, 400 with a respective rectangular extension portion 303, 404 to which the spigot 6 is attached or, at least, extends therethrough. Each of the extendable members 3, 4 is cut from the intermediate sheet 20 such that each member 3, 4 is locatable, in a fully withdrawn position, within the gap left after it 3, 4 has been excised.

Figure 3:
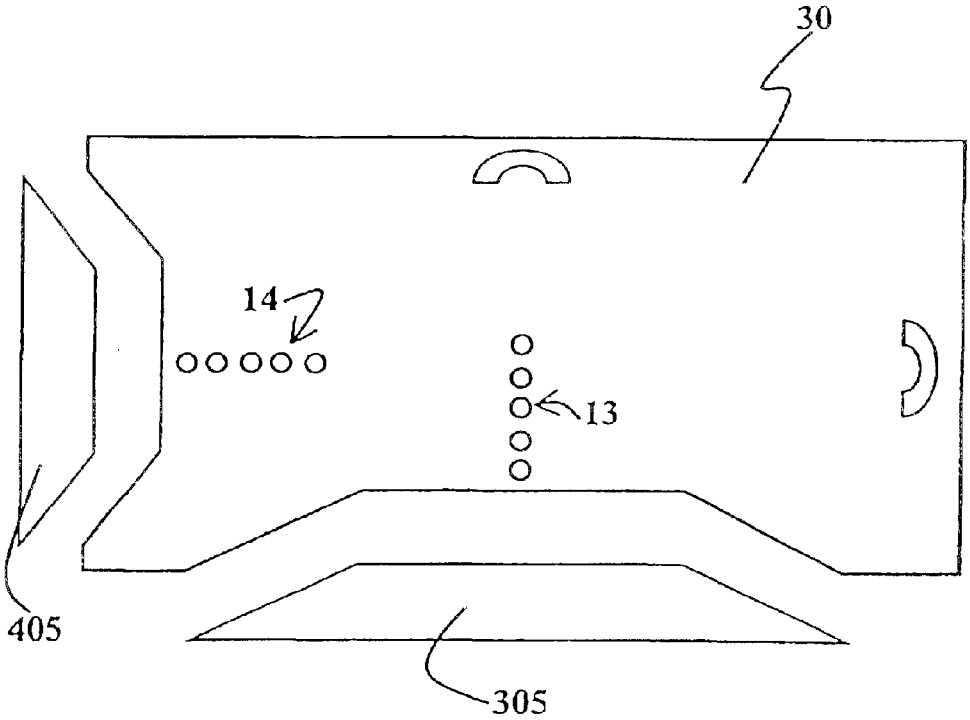
FIG. 3 shows a further section through the device of FIG. 1.

FIG. 3 shows the third or lowermost sheet 30, which comprises a series of cavities 13, 14 aligned with the path of travel of each of the spigots 6 upon extension of the members 3, 4. The sheet 30 also has two trapeziums 305, 405 cut-out therefrom which are attached, such as adhered, respectively, to the trapezium portions 300, 400 of the extendable members 3, 4.

Figure 3A:
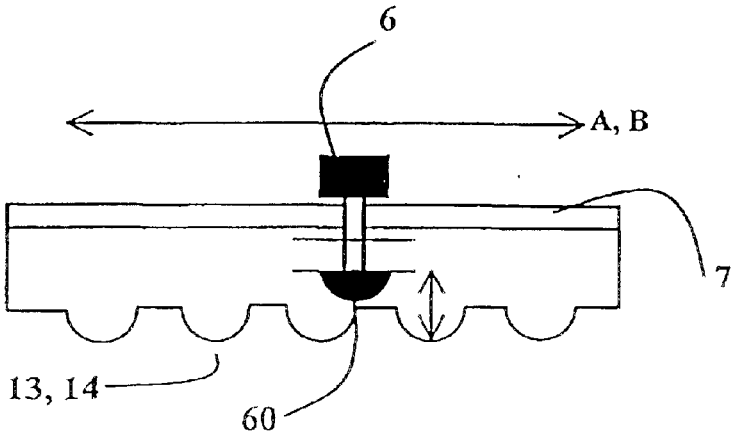
FIG. 3A shows a detail of the device of FIG. 1.

The series of cavities 13, 14 allow for location of the base or bottom 60 of the spigot 6 therein upon sliding travel of the spigot 6 within the guide 7. As shown in FIG. 3A, the bottom of the spigot 6 comprises a resiliently urged member 60 which is locatable within each of the series of cavities 13, 14. As the spigot 6 slides or is slid within the guide 7 in the direction of arrow A or B, the resiliently urged member 60 locates within one of the cavities of the series 13, 14 to afford the member 3, 4 an accurate and monitorable extension length.

Figure 4:
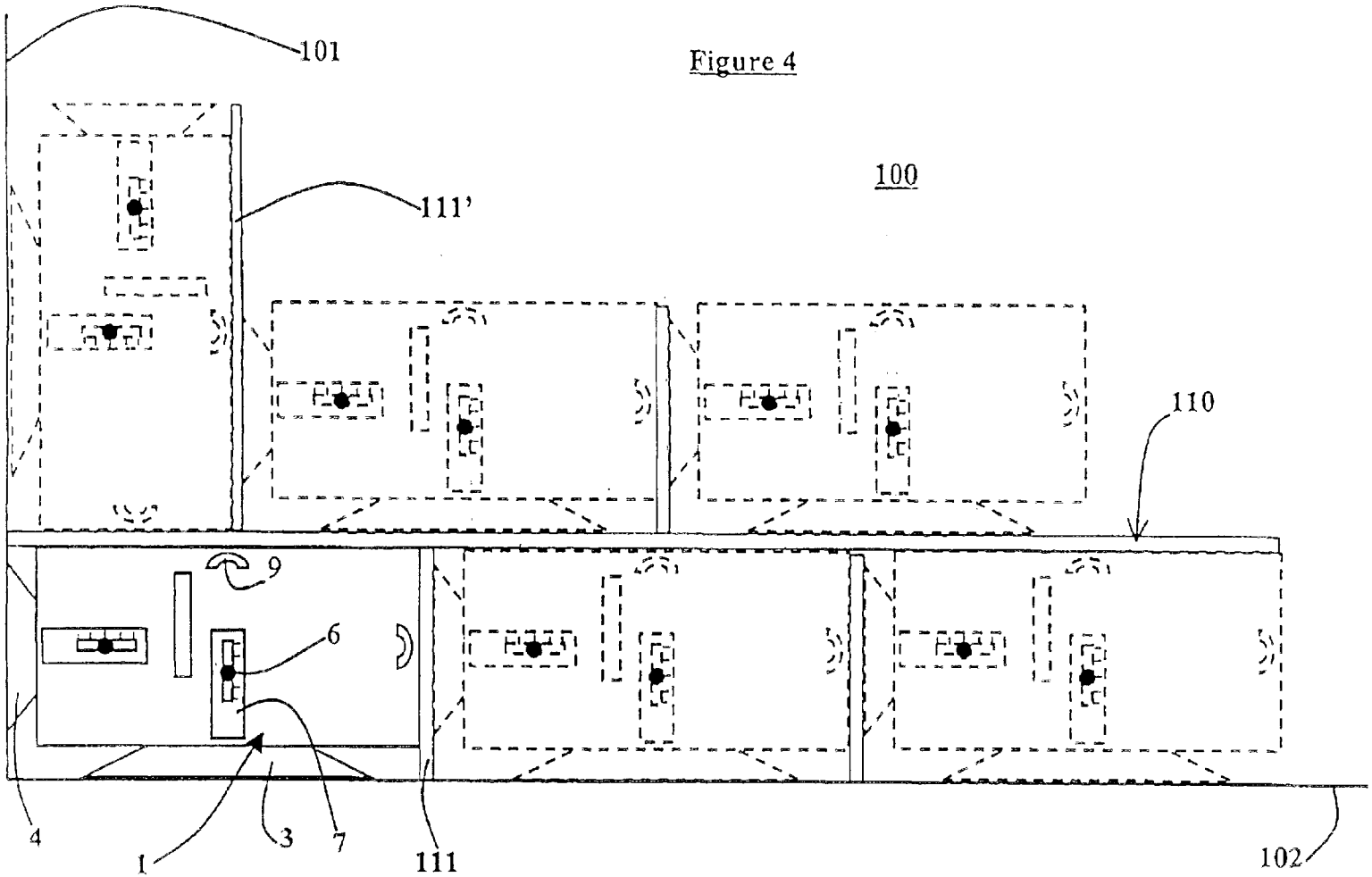
FIG. 4 shows a section of wall with the indicated positions of the device of FIG. 1.

Referring now to FIG. 4, there is shown a device 1 which has been located at the corner of a surface 100, at the corner of two walls 101, 102. As can be clearly seen, a medium extension of the members 3, 4 has been set by sliding the spigot to the mid-point of the guide 7, thereby locating the resilient member 60 of each spigot 6 into the middle one of the series of cavities 13, 14.

Once the extension length of the members 3, 4 has been set, the device 1 is placed upon the surface 100 and the pattern 110 marked out by a suitable marker. The spirit level 9 ensures that that device 1 is level. If the walls 101, 102 are level then the spirit level 9 simply serves as a further guide ensuring the level of the device 1. Once the pattern 110 has been marked out upon the surface 100 the device is moved such that the requisite extendable member 3, 4 abuts the edge of the pattern 110 and a similar pattern 110 is marked out around that subsequent position. In FIG. 4 the subsequent positions are indicated by the outlines of the device 1, shown in dotted lines.

The device 1 as shown is, as previously stated, of rectangular form. Preferably, the long edges of the rectangle are twice the length of the short edges. With any particular configuration of the device 1, each of the extendable members 3, 4 can be utilised to mark out a pattern 110 as is indicated in FIG. 4.

If a conventional "brickwork" pattern is desired, the short edge member 4 (with the short edge of the device 1 being half the length of the long edge) can be used to provide an, as indicated, vertical pattern line 111' which is half the distance from the wall 101 that a corresponding pattern line would have been if the long edge member 3 had been horizontally aligned and abutting the pattern line (as per 111). This, of course, holds as long as the extendable members 3, 4 are set to identical extensions.

Obviously, if a required the extendable members 3, 4 may be withdrawn to their closed position where the do not protrude from the edges of the device 1.

In certain cases, a pattern may be required which is composed of a random array of shapes. This is readily achieved by altering the extensions of the extendable members 3, 4 prior to drawing out each pattern 111. This will provide an array of lines which define rectangles of varying sizes. Indeed, whilst marking out a pattern to provide a stone-effect upon a surface using, for example, the method and/or composition of my co-pending British Patent Application No. 9928515.7, such an approach may well lead to an improved stone-effect look.

Figure 12:
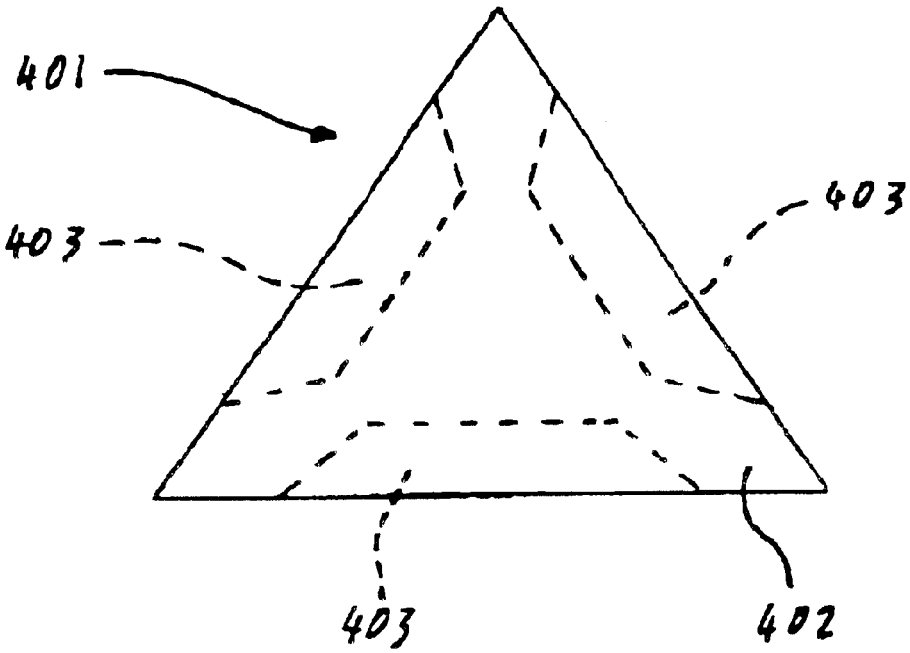
FIG. 12 shows a plan view of a further embodiment of the device.

Whilst the above description has shown the device 1 to be of rectangular form, the device 401 could be fabricated in triangular form as illustrated in FIG. 12 or, indeed, any other polygonal shape, for example an array of hexagons or pentagons may be desired. In such cases, the members 403 may extend from non-parallel edges of the device. Alternatively and/or additionally, members 403 could be extendable form each side of the device. Both of these latter features are shown in FIG. 12.

The device 1 described in relation to the drawings shows the extension means 5 providing a stable configuration for discrete extensions of each member 3, 4, which is to say when the bottom 60 of the spigot 6 is resiliently urged and located in one of the array of cavities 13, 14. This obviously ensures ease of use of the device 1, although it may be desired to provide a continuous extension. In such a case, a simple nut and bolt mechanism which can lock or secure the extendable member 3, 4 at the required extension may be provided, in place of the extension means 5.

Moreover, it was stated above that the device 1 was formed from a laminate of three sheets 10, 20, 30. Obviously, with plastics forming technology, such as moulding and casting, the upper, middle and lower sheets 10, 20, 30 can be unitarily formed from a rigid plastics material such as nylon, polytetrafluoroethylene or polyester for example. If this approach is adopted, the body 2 of the device 1 may be formed with an aperture to allow the extendable members 3, 4 to slide inwards and outwards of the device 1, the lowermost portion 30 being provided with the array of cavities 13, 14 at the forming stage.

Figure 5:
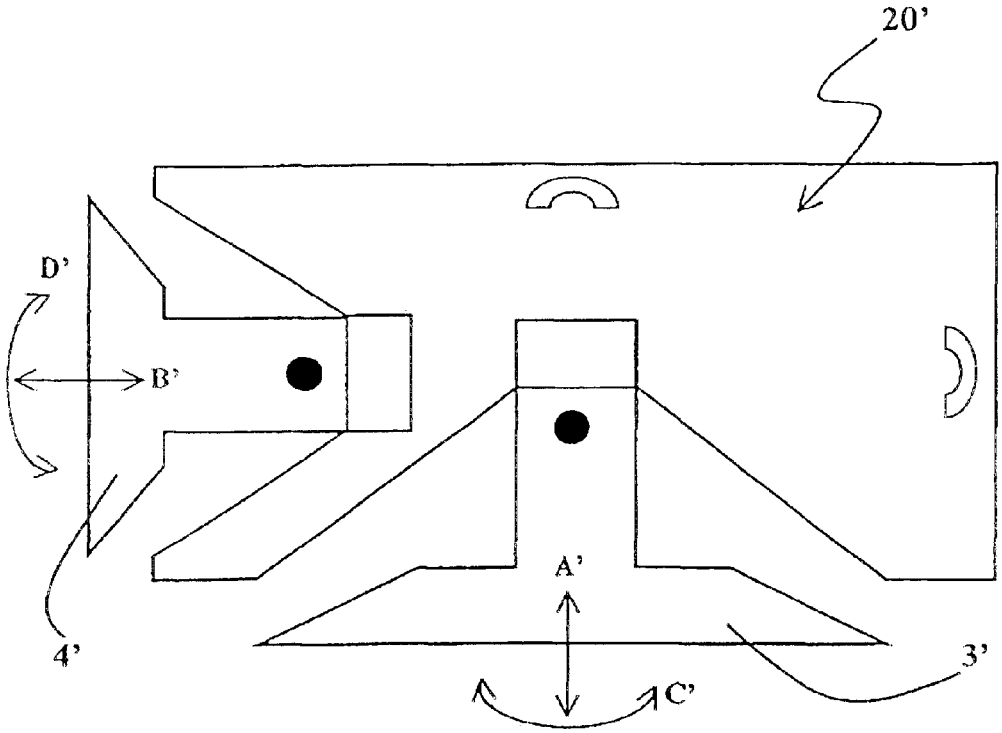
FIG. 5 shows a section through another embodiment of the inventive device.
Figure 6:
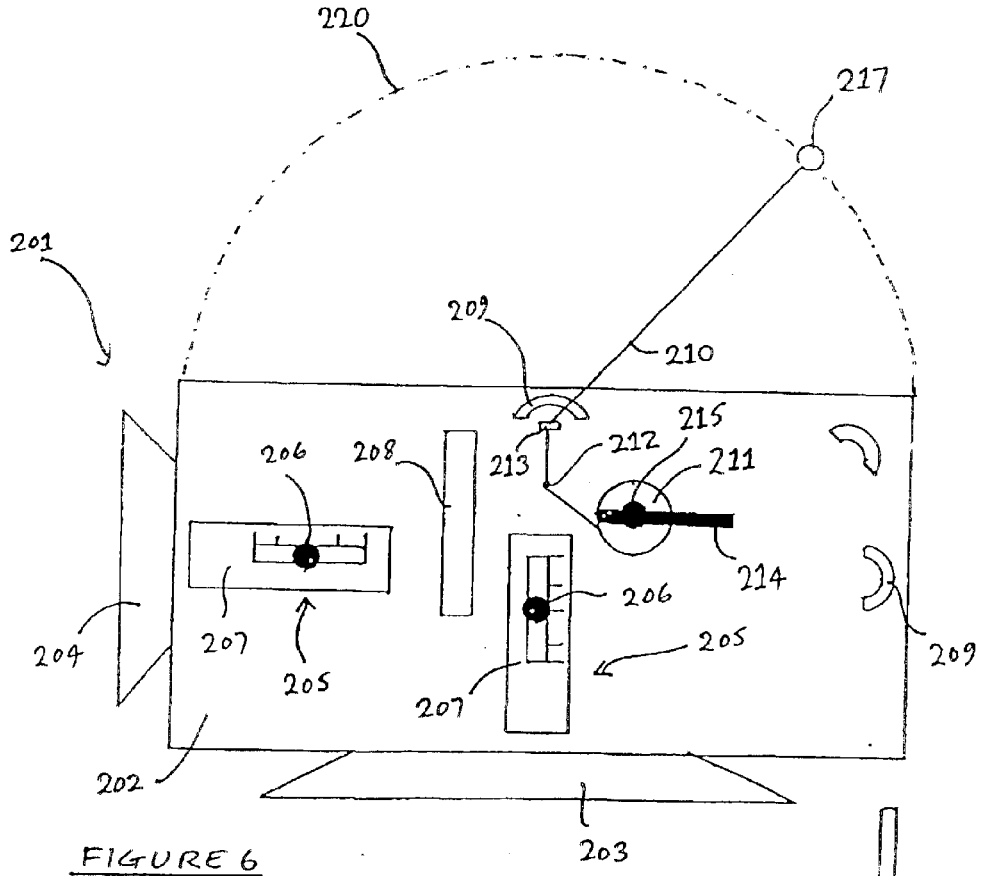
FIG. 6 shows a plan view of a further embodiment of the device.
Figure 7:
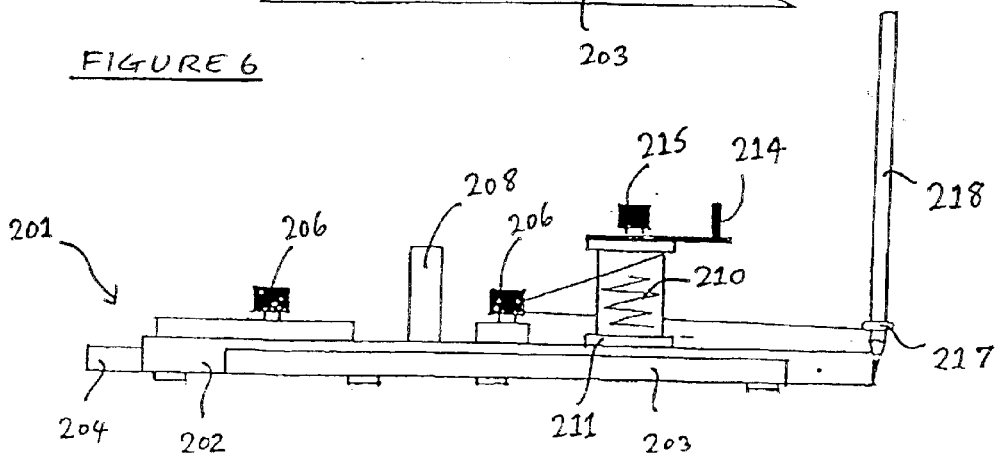
FIG. 7 shows a side elevation of the device of FIG. 6.
Figure 8:
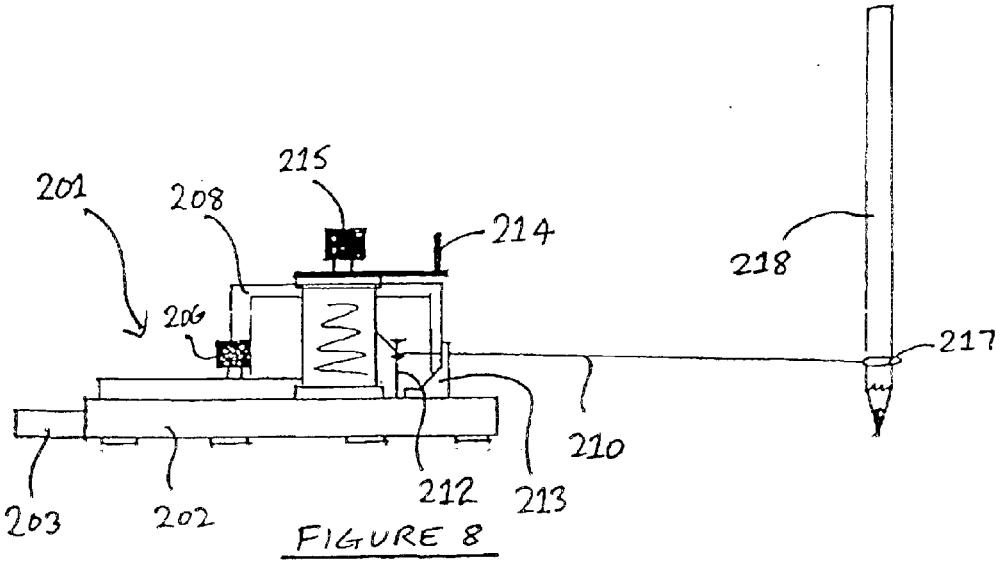
FIG. 8 shows an end elevation of the device of FIGS. 6 and 7.
Figure 9:
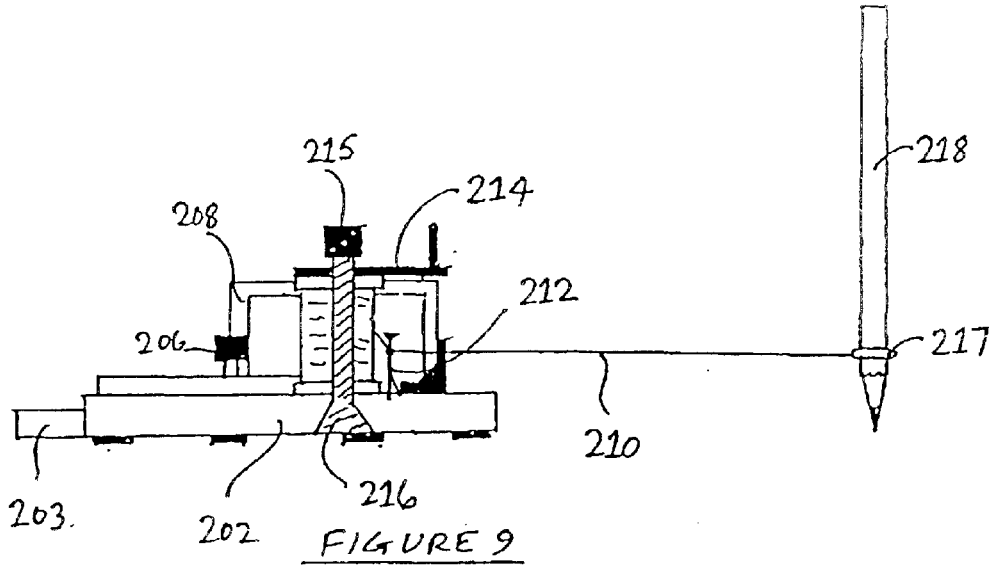
FIG. 9 shows a partial section of the end elevation of the device shown in FIG. 8.

In a further embodiment, and as indicated in FIG. 5, in which only the intermediate layer or sheet 20' is shown, each extendable member 3', 4' may be at least partially rotatable in the plane of the device 1' about the spigot 6'.

In this embodiment, the members 3', 4' are extendable from the device 1' as before, indicated by arrows A', B', but the apertures 21', 22' in which they slide are arranged to allow rotation of each member 3', 4' about the spigot 6' in the direction of arrows C' and D' respectively. In order to secure or locate each member 3', 4' in any particular configuration, either a nut and bolt arrangement is used, in which case the spigot 6' comprises a bolt whose free end of the shank protrudes from the uppermost sheets or layer of the device 1'. Alternatively, a resiliently urged spigot 6 may be used together with a locking means such as a pin, nut and bolt or other means known in the arts to ensure accurate rotational location of each member 3', 4'.

With such a device 1' a pattern similar to that described in relation to FIG. 4 is definable as well as, for example, a herringbone design. Moreover, a combination of regular and irregular patterns can be defined or a completely irregular array can be described.

When marking out the pattern 110 around a device 1, 1', any suitable marker may be used. If the device 1, 1' is used to mark out a pattern 110 prior to applying a composition in accordance with my co-pending British Patent Application No. 9928515.7 then a 'permanent' spirit-based marker may be used. Indeed, depending upon the colour of the marker and the colour of the composition applied the so marked-out pattern may provide an impression of mortar. If one is to attempt to achieve such a result an oil-based marker should be used if water-based compositions are applied.

Referring now to FIGS. 6 to 9 of the drawings, a further embodiment of measuring device shown generally at 201, is very similar to the device 1 described above with reference to at least FIGS. 1 and 1A, in that it comprises a laminar generally rectangular base 202, two extendable members 203, 204, associated extension means 205 having a spigot 206 slidable within a graduated guide 207, a handle 208 and a pair of spirit levels 209. However, this further embodiment also includes means for marking-out arcuate or other curved patterns on a surface beyond the area of the body base 202 of the device 201.

Such means comprises a supply of string 210 wound on a reel 211 and extending around a spindle 212 and through a small hole (not shown) in a guide. plate 213, the hole defining a centre point. The reel 211 is provided with a winding handle 214 and a locking nut 215 secured to the end of a bolt 216 extending through the base 202. The free end of the string 210 remote from the reel 211 and beyond the base 202, has a ring 217 in which is received a marker in the form of a pencil 218.

In use of the marking-out means, the string 210 is unwound from the reel 211 to the required length to traverse a predetermined arc about the centre point defined by the hole in the guide plate 213, such as the semi-circle shown in chain-dotted line at 220, with its associated marker, namely the pencil 218, received in the ring 217. The locking nut 215 may be tightened to maintain the length of string 210 at this required length. However, the length of the string 210 may be adjusted to provide arcs of different radii.

A further, generally diagonally-disposed spirit level 219 is provided at a right hand corner of the base 202.

Thus, this further embodiment of measuring device 201 can be used not only in the same manner as the two previous embodiments described above in relation to FIGS. 1 to 5 but also to provide arcuate or other curved markings with the additional marking-out means described above in relation to FIGS. 6 to 9.

Figure 10:
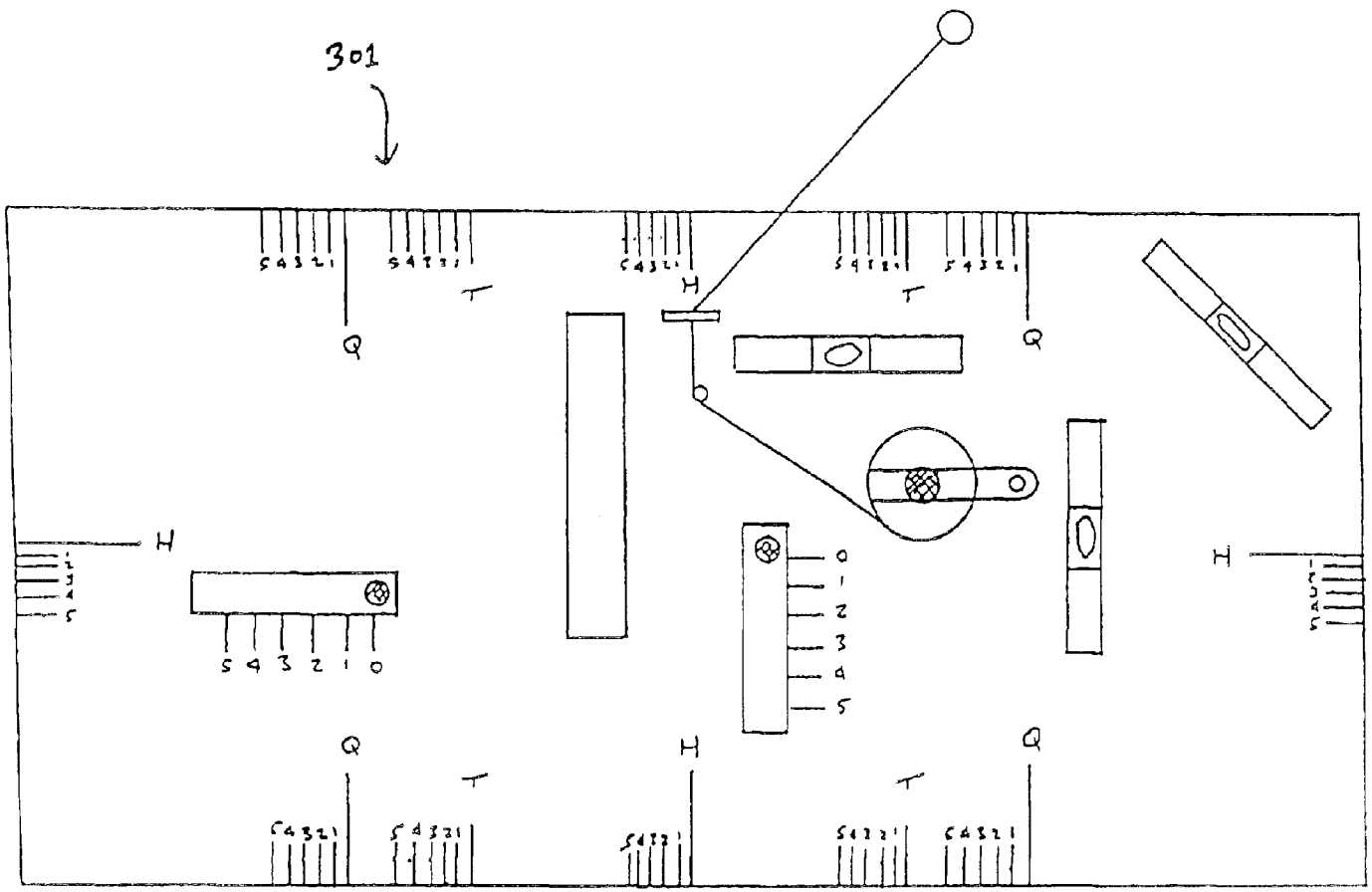
FIGS. 10 and 11 show respective plan views of yet a further embodiment of the device with its extendable members in their closed and fully extended positions.
Figure 11:
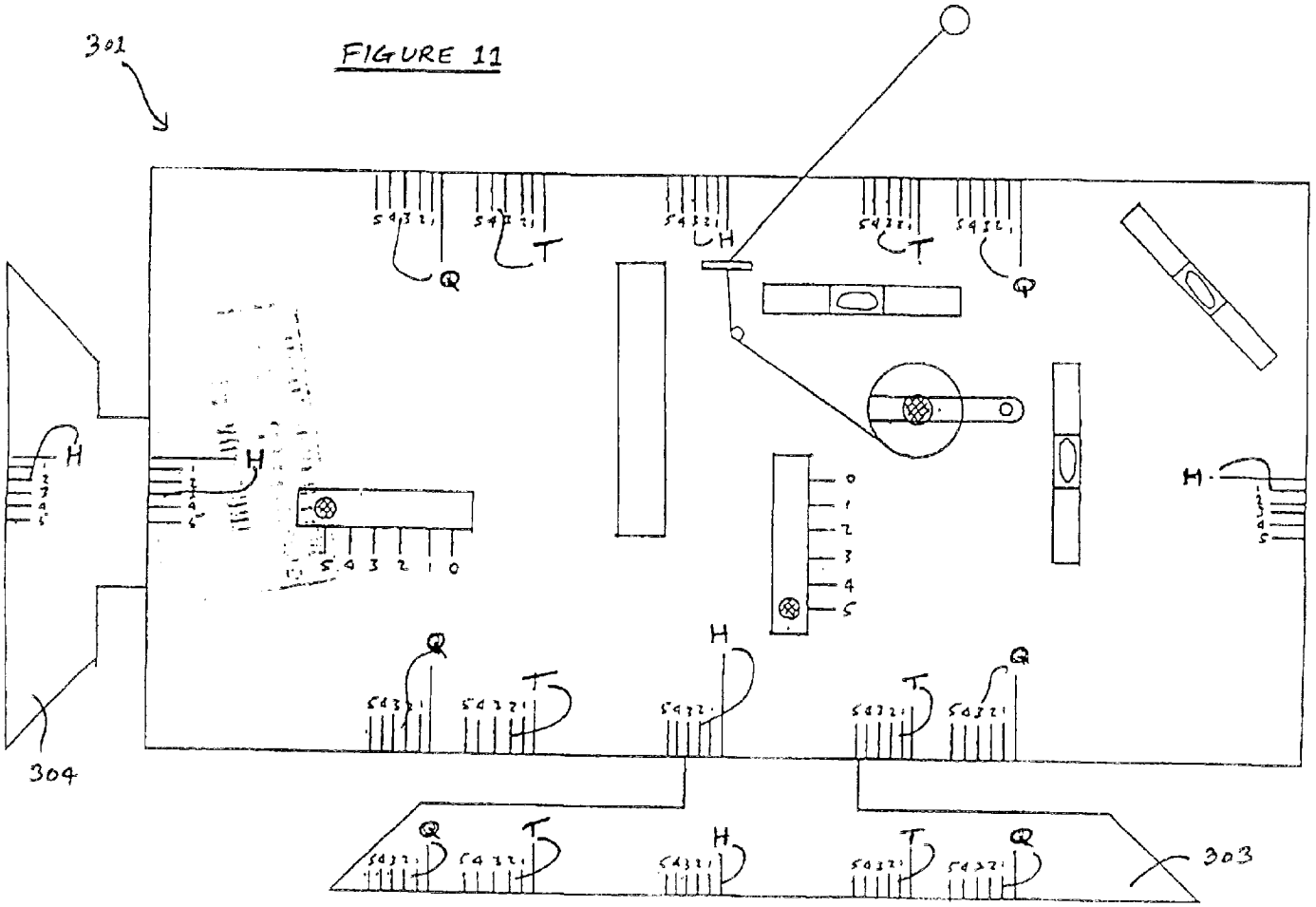

Shown in FIGS. 10 and 11 is yet a further embodiment of measuring device 301 which is similar to that described above with reference to FIGS. 6 to 9, except that it is provided with additional scales, and which has its extendable members 303, 304 in their respective closed and fully-extended positions.

The additional scales H, T and Q are used for measuring and determining various lengths associated with the function of the members 303, 304 and/or marking-out means.

Accordingly, it is clear that each device may be utilised to define a pattern upon a surface. Such a device may be used to provide a series of rectangles or other shapes which may describe an irregular or regular pattern. Such a device may be used in the decorating, building or building maintenance trade as well as any other trade where a pattern is required consisting of an array of shapes.

What is claimed is:

1. A method of marking out a pattern upon a surface using a device comprising a body which is holdable against the surface for the marking out of a pattern thereon wherein a portion of the device body defines at least a portion of a pattern to be marked out, said device having a member extendable from the body, the method comprising the steps of:

adjusting the amount by which the extendable member is extended from the body of the device; and holding the device with its extendable member against the surface and using at least a portion of the device body and the extendable member to mark out at least a portion of a desired pattern upon the surface, wherein an area of a pattern to be marked out is dependent on the amount by which the extendable member is extended from the device body.

2. A method according to claim 1, further comprising extending the extendable member from the body so as to provide an abutment surface at a location distant from the body.

3. A method according to claim 2, further comprising determining and monitoring the amount of extension from the body for the or each member.

4. A method according to claim 3, further comprising extending each member by the same extension, thereby providing the pattern to be marked out with an aspect ratio identical to that defined by the device if no such extension of each member had been effected.

5. A method according to claim 1, wherein the device comprises at least two extendable members.

6. A method according to claim 5, wherein each of the members extend or are extendable from non-parallel faces or edges of the body of the device.

7. A method according to claim 5, further comprising extending each extendable member from the body so as to provide respective abutment surfaces at locations distant from the body.

8. A method according to claim 5, further comprising extending one member from each of two orthogonal sides or faces of a rectangular body, the sides or faces thereof from which members are not extended comprising the portion of the device around which the desired pattern upon the surface is marked or markable.

* * * * *